US005711555A

United States Patent [19]

Leedy

[11] Patent Number: 5,711,555

[45] Date of Patent: Jan. 27, 1998

[54] COMBINATION GRAB BAR AND DOOR LOCK

[76] Inventor: Melvin Leedy, 11771 S. Helen Dr., Yuma, Ariz. 85367-6622

[21] Appl. No.: 525,363

[22] Filed: Sep. 7, 1995

[51] Int. Cl.[6] ..... E05C 3/04

[52] U.S. Cl. ..... 292/202; 292/205; 292/297

[58] Field of Search ..... 292/202, 278, 292/304, 205, 210, 259 A, 285, 297, 298, DIG. 17, 281; 70/14, 57, 77, 91, 93, 101, 135, 203, 212; 16/112, 113, 126, 82

[56] References Cited

U.S. PATENT DOCUMENTS

| | | | |
|---|---|---|---|
| 341,025 | 5/1886 | Letzing | 70/93 |
| 879,948 | 2/1908 | Durett | 70/135 |
| 1,015,338 | 1/1912 | Peel | 292/205 |
| 1,958,029 | 5/1934 | Ballwanz et al. | 292/278 |
| 2,577,878 | 12/1951 | Camp | 292/205 |
| 3,273,747 | 9/1966 | Kalz | 292/256 |
| 3,971,238 | 7/1976 | Walker | 70/135 |
| 4,331,356 | 5/1982 | Noel | 292/281 |
| 4,664,227 | 5/1987 | Hansen | 182/82 |
| 4,908,906 | 3/1990 | Hanna | 16/126 |
| 5,018,302 | 5/1991 | Kluge | 49/56 |
| 5,076,547 | 12/1991 | Osterholm | 256/67 |
| 5,280,986 | 1/1994 | Friesen et al. | 296/57.1 |
| 5,286,073 | 2/1994 | Ui | 292/216 |
| 5,397,143 | 3/1995 | Bird | 280/166 |
| 5,524,943 | 6/1996 | Bottaro | 292/56 |

FOREIGN PATENT DOCUMENTS

| | | | |
|---|---|---|---|
| 681091 | 8/1939 | Germany | 70/93 |

*Primary Examiner*—Rodney M. Lindsey
*Assistant Examiner*—Gary Estremsky
*Attorney, Agent, or Firm*—Martin L. Stoneman

[57] ABSTRACT

This invention provides a combination grab bar and door lock for grab bar systems of the type wherein a grab bar is mounted outside a recreational vehicle and adjacent an outward-opening door. It provides a grab bar system wherein the grab bar means may be optionally positioned adjacent to an outside portion of the door and locked into such position, thereby barring the opening of the door.

5 Claims, 2 Drawing Sheets

COMBINATION GRAB BAR AND DOOR LOCK

BACKGROUND OF THE INVENTION

1. Field of the Invention

This invention relates to providing a combination grab bar and door lock for grab bar systems of the type wherein a grab bar is mounted outside a recreational vehicle and adjacent an outward-opening door. More particularly, this invention concerns a grab bar system wherein the grab bar means may be optionally positioned adjacent to an outside portion of the door and locked into such position, thereby barring the opening of the door.

2. Description of the Prior Art

In the prior art, it is not unusual for the builder or user of a motor home or other recreational vehicle to provide a grab bar or courtesy handle next to the door of such vehicle to assist the occupants in entering. More often than not, even if one or several stairsteps are provided, typically a banister are not provided; thus such grab bars are common. It has even been provided in the prior art, since grab bars typically extend out at least a few inches from the recreational vehicle, that such grab bars may be folded against the side of the recreational vehicle or otherwise moved out of the way during travel of the vehicle.

Also, it is not unusual in such motor homes and the like for there to be provided only a single door thereto, typically opening outward. Thus, only one door must be locked to normally protect the vehicle contents. However, in this day and age of increased burglary and similar thefts and crimes, there exists a safety need not only for securely locking such doors on such motor homes and the like, but also a need to lock such doors so that they cannot be opened outward from the inside. This is because thieves and the like commonly gain access through a window or other opening; and then such thieves may typically open the door from the inside so as to provide a handy exit through which to remove even large items from the vehicle, often without calling attention to the situation from others nearby.

OBJECTS OF THE INVENTION

A primary object of the present invention is to fulfill the above-mentioned safety need by the provision of a system for securely locking such door of such vehicles from the outside so that such door can not be opened from the inside. A further primary object of the present invention is to provide such a system which is efficient, inexpensive, and handy. In addition, it is a primary object of this invention to provide such system in connection with and making use of the grab bar means already desired for such vehicles. Other objects of this invention will become apparent with reference to the following invention descriptions.

SUMMARY OF THE INVENTION

According to a highly-preferred embodiment of the present invention, this invention provides, in a grab bar system of the type wherein a grab bar is mounted outside a recreational vehicle and adjacent an outward-opening door, the steps of: mounting such grab bar to such recreational vehicle in a swivelable manner in such manner that such grab bar may be optionally positioned for assisting entry to such recreational vehicle or for barring opening of such door; positioning such grab bar for barring opening of such door; and locking such grab bar in position for barring opening of such door.

Furthermore, according to such preferred embodiment of this invention, there is provided, in a grab bar system of the type wherein a grab bar is mounted outside a recreational vehicle and adjacent an outward-opening door, the improvement comprising, in combination: grab bar means for assisting entry to such recreational vehicle; positioning means for (1) positioning such grab bar means into a first position for assisting entry to such recreational vehicle and (2) positioning such grab bar means into a second position for restricting any opening of such door. Further provided by this invention, according to the preferred embodiment, are locking means for locking such grab bar means in such second position for restricting any opening of such door. Also provided are locking means for locking such grab bar means in such first position for assisting entry to such recreational vehicle.

Additionally, the present invention provides, according to the preferred embodiment, such improvement wherein such positioning means includes means for positioning such grab bar means into a third position for stowing flat against such recreational vehicle for safe travel. And this invention even further provides such improvement further comprising locking means for locking such grab bar means in such third position for stowing flat against such recreational vehicle for safe travel. Further provided is such improvement wherein such positioning means comprises mounting means for mounting such grab bar means on such recreational vehicle in such manner as to permit pivoting of such grab bar means about a vertical axis next to such recreational vehicle; and wherein such grab bar means comprises at least one vertical end having a substantially circular cross section; and wherein such mounting means comprises at least one substantially vertical hollow cylinder for receiving such vertical end of such grab bar means.

Yet additionally, according to the preferred embodiment, the present invention provides such improvement wherein such locking means for locking such grab bar means in such second position for restricting any opening of such door comprises at least one substantially horizontal first hole in such vertical end of such grab bar means; at least one substantially horizontal second hole in such hollow cylinder, such first hole and such second hole being positioned substantially in line; and lockable bar means for passing through both such first hole and such second hole. Also so provided is such improvement wherein such locking means for locking such grab bar means in such first position for assisting entry to such recreational vehicle comprises: at least one such substantially horizontal first hole in such vertical end of such grab bar means; at least one substantially horizontal third hole in such hollow cylinder, such first hole and such third hole being positioned substantially in line; and lockable bar means for passing through both such first hole and such third hole.

Yet even further, this invention provides, in accordance with a preferred embodiment, such improvement wherein such locking means for locking such grab bar means in such third position for stowing flat against such recreational vehicle for safe travel comprises: at least one such substantially horizontal first hole in such vertical end of such grab bar means; at least one such substantially horizontal second hole in such hollow cylinder, such first hole and such second hole being positioned substantially in line; and lockable bar means for passing through both such first hole and such second hole. Also so provided is such improvement wherein such grab bar means comprises a bar lying essentially within a vertical plane and pivotable around such vertical axis of such vertical hollow cylinder. And this invention also so provides such improvement wherein such grab bar means, such positioning means and such locking means are structured and arranged for (1) locking such grab bar means, for assisting entry to such recreational vehicle, into a such first position essentially perpendicular to the plane of such door when such door is in a closed position, and (2) locking such grab bar means, for barring opening of such door, into a such second position adjacent to an outside portion of such door and essentially parallel to such plane of such door when such door is in a closed position.

Even additionally provided by the present invention, in accordance with a preferred embodiment, in a grab bar system of the type wherein a grab bar is mounted outside a recreational vehicle and adjacent an outward-opening door, is the improvement comprising, in combination: a grab bar, lying essentially in a vertical plane, for assisting entry to such recreational vehicle when such grab bar is in a first position in a plane essentially perpendicular to the plane of such door when such door is in a closed position, such grab bar having a longest horizontal dimension longer than the distance from such door to the location where such grab bar is mounted; mounting means for mounting such grab bar on such recreational vehicle in such manner as to permit pivoting of such grab bar means about a vertical axis next to such recreational vehicle; and locking means structured and arranged for (1) locking such grab bar, for assisting entry to such recreational vehicle, into such first position essentially perpendicular to such plane of such door when such door is in a closed position, and (2) locking such grab bar, for barring opening of such door, into a second position adjacent to an outside portion of such door and essentially parallel to such plane of such door when such door is in a closed position.

Yet further so provided is such improvement wherein such grab bar comprises a handle portion having an upper and a lower cylindrical end portion, each such cylindrical end portion being vertical and pointed downward; also, wherein such mounting means comprises an upper substantially vertical hollow cylinder for receiving such upper cylindrical end portion of such grab bar and a lower substantially vertical hollow cylinder for receiving such upper cylindrical end portion of such grab bar; and, also, wherein such locking means comprise: at least one substantially horizontal first hole in at least one of such vertical end portions of such grab bar means; at least one substantially horizontal second hole in at least one of such hollow cylinders; such first hole and such second hole being positioned substantially in line; and lockable bar means for passing through both such first hole and such second hole.

The present invention additionally provides such improvement wherein: such first hole lies in such vertical plane of such grab bar; such at least one of such hollow cylinders includes a such second hole essentially perpendicular to such plane of such door when such door is in a closed position; such at least one of such hollow cylinders includes another such second hole essentially parallel to such plane of such door when such door is in a closed position; such first hole, such second hole, and such other second hole being positioned in essentially the same horizontal plane; such lockable bar means is structured and arranged for (1) passing through both such first hole and such second hole essentially perpendicular to such plane of such door when such door is in a closed position, to lock such grab bar in position for assisting entry to such recreational vehicle, and (2) passing through both such first hole and such other second hole essentially parallel to such plane of such door when such door is in a closed position, to lock such grab bar in position for barring opening of such door. Such improvement is also provided by this invention wherein such lockable bar means is structured and arranged for passing through both such first hole and such other second hole essentially parallel to such plane of such door when such door is in a closed position, to lock such grab bar in position for stowing flat against such recreational vehicle for safe travel.

Yet even further provided by the present invention, according to a preferred embodiment, are, in a grab bar system of the type wherein a grab bar is mounted outside a recreational vehicle and adjacent an outward-opening door, the steps of: mounting such grab bar to such recreational vehicle in a swivelable manner in such manner that such grab bar may be optionally positioned for assisting entry to such recreational vehicle or for barring opening of such door; positioning such grab bar for barring opening of such door; and locking such grab bar in position for barring opening of such door.

DETAILED DESCRIPTION OF A PREFERRED EMBODIMENT AND THE BEST MODE OF PRACTICE

Figure 1:
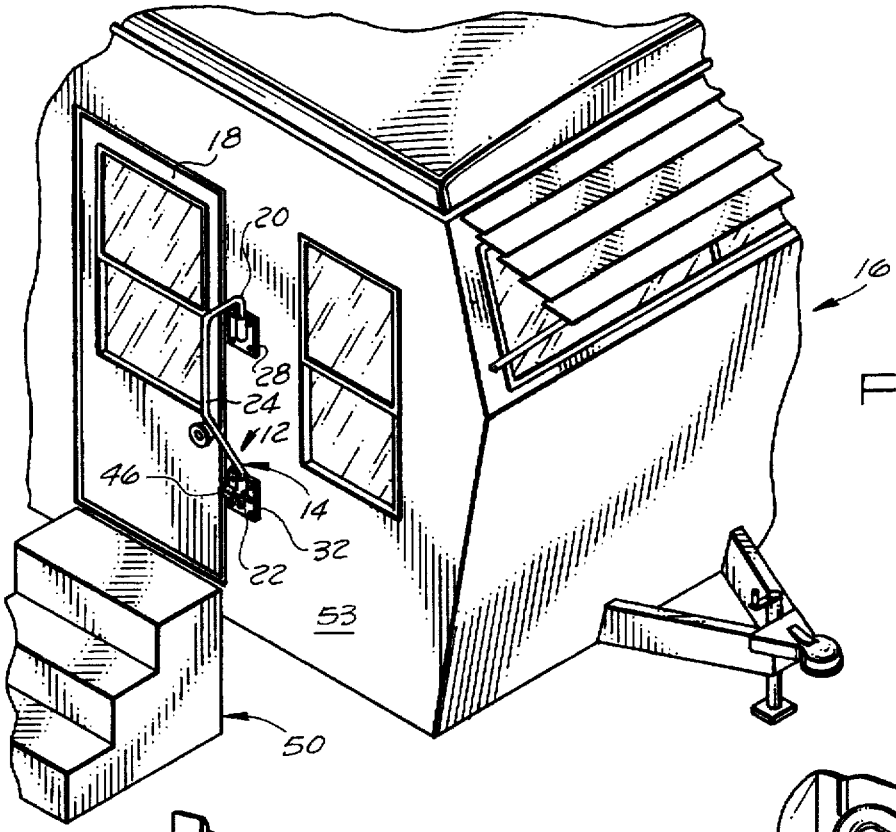
FIG. 1 illustrates pictorially, in perspective, the grab bar system of a preferred embodiment according to the present invention in position for use for assisting entry to a recreational vehicle.

With reference to FIGS. 1–6, the grab bar system 12 of the illustrated preferred embodiment of the present invention is preferred for use wherein a grab bar means shaped something like the illustrated grab bar 14, for grabbing, is mounted outside a recreational vehicle 16 and adjacent an outward-opening door 18, in a common position for assisting entry to the recreational vehicle 16, as shown in FIG. 1.

The illustrated preferred grab bar system 12, as shown in FIGS. 1–6, includes grab bar means in the form of grab bar 14. Grab bar 14 includes an upper cylindrical end portion 20, which is vertical and is pointed downward; and grab bar 14 includes a lower cylindrical end portion 22, which is also vertical and pointed downward. Handle portion 24 of grab bar 14 lies between the grab bar end portions 20 and 22. In the illustrated preferred embodiment, mounting means 26 includes, as part of upper mounting bracket 28, an upper substantially vertical hollow cylinder 30 for receiving the upper cylindrical end portion 20 of grab bar 14 in a sliding fit; and mounting means 26 also includes, as part of lower mounting bracket 32, a lower substantially vertical hollow cylinder 34 for receiving the lower cylindrical end portion 22 of grab bar 14 in a sliding fit.

Figure 4:
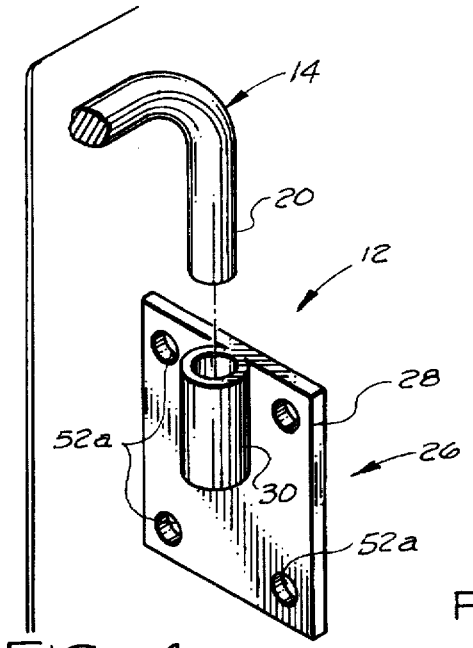
FIG. 4 is a partial expanded and exploded view, partially in section, illustrating, in perspective, individual parts of the preferred embodiment of FIG. 1 of grab bar system of the present invention.
Figure 6:
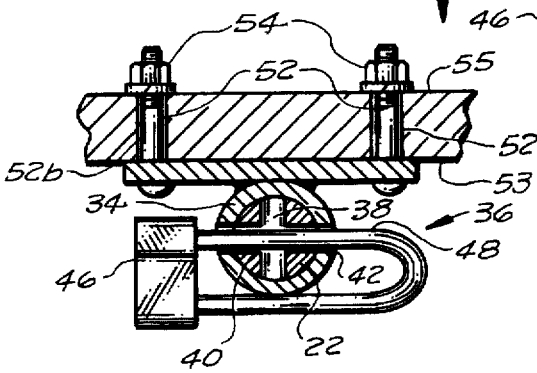
FIG. 6 is a top view, partially in section, through the section 6—6 of FIG. 5, showing details of the locking means of the preferred embodiment of FIG. 1 of the present invention.
Figure 8:
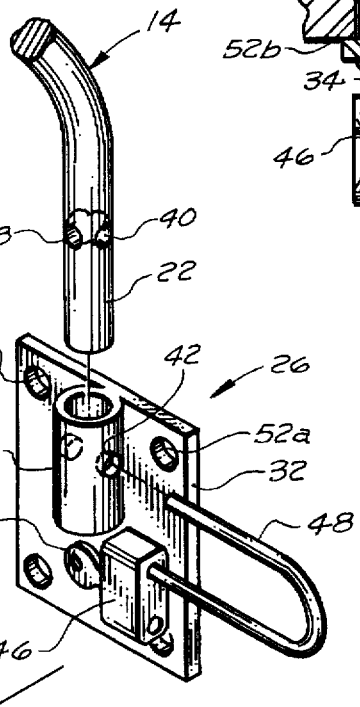
FIG. 8 is a perspective view showing the locking means of the embodiment of FIG. 7 in locked position.
Figure 8:
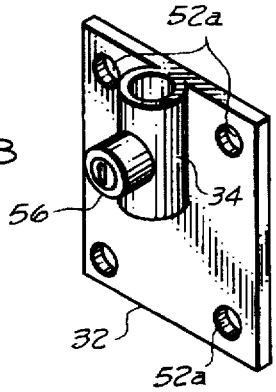
Figure 7:
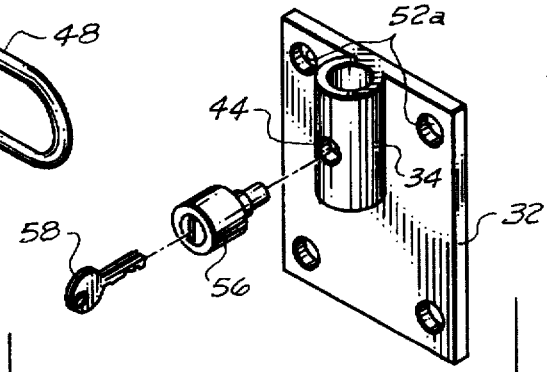
FIG. 7 is an exploded view, in perspective, illustrating another preferred embodiment of the locking means of the present invention.

In the illustrated preferred embodiment, locking means 36 includes, as shown best in FIGS. 4 and 6, two substantially horizontal holes 38 and 40 through lower end portion 22 of grab bar 14. First hole 38 in end portion 22 is in the plane of grab bar 14, which, in the preferred embodiment, as shown, is substantially in a vertical plane. Second hole 40 in end portion 22 is in the same horizontal plane as first hole 38 but is perpendicular to first hole 38, that is, perpendicular to the vertical plane of grab bar 14. In the illustrated preferred embodiment, locking means 36 further includes horizontal hole 42 through lower substantially vertical hollow cylinder 34, which hole 42 lies parallel to the plane of closed door 18, as shown. (Optionally, a second horizontal hole 44 perpendicular to closed door 18 may be provided for a locking means as shown in the embodiment of FIGS. 7 and 8.) In the illustrated preferred embodiment, locking means 36 also includes padlock 46, a bar portion 48 of which may pass through hole 42 and one of holes 38 or 40, depending upon which position grab bar 14 is to be locked in.

Figure 5:
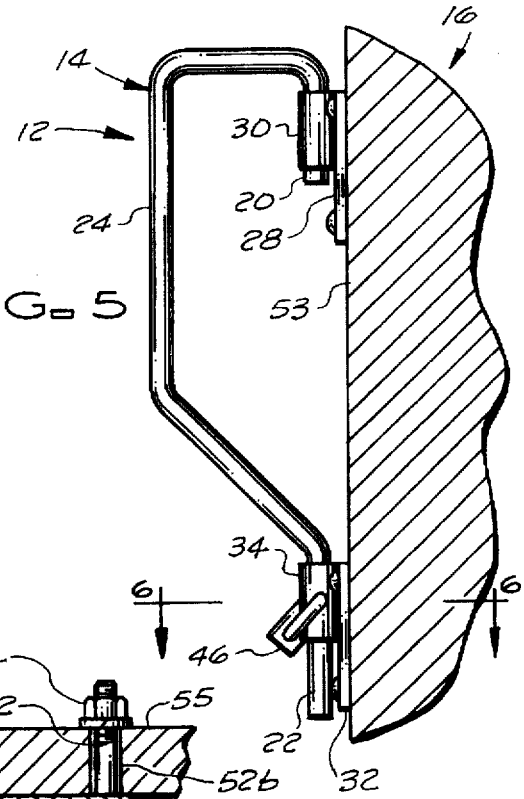
FIG. 5 is an expanded side view illustrating the grab bar system of the embodiment of FIG. 1 of the present invention and showing the grab bar in position for assisting entry to a recreational vehicle.

In operation, according to the illustrated preferred embodiment, grab bar 14 (as shown best in FIG. 4) is placed downwardly in to mounting means 26 until a stable position is reached with upper end portion 20 within upper cylinder 30 and lower end portion 22 within lower cylinder 34. The positioning means of the present invention according to the illustrated preferred embodiment, that is, that, since both end portions 20 and 22 are cylindrical and fit slidingly within, respectively, hollow cylinders 30 and 34, as shown, that grab bar 14 may be easily rotated, i.e., pivoted or swiveled, into any of the positions shown in the drawings (after which positioning grab bar 14 may be locked). With reference to FIGS. 1, 5, and 6, grab bar 14 may be locked into the position in which grab bar 14 may assist the entry through door 18 into recreational vehicle 16 of persons climbing stairs 50, very helpful since usually such stairs do not include support-grabs like a banister. In this position for assisting entry, a bar portion 48 of padlock 46 will be made to pass through holes 42 and 40, which are constructed to be aligned when grab bar 14 settles into a said stable position and is properly rotated.

Figure 2:
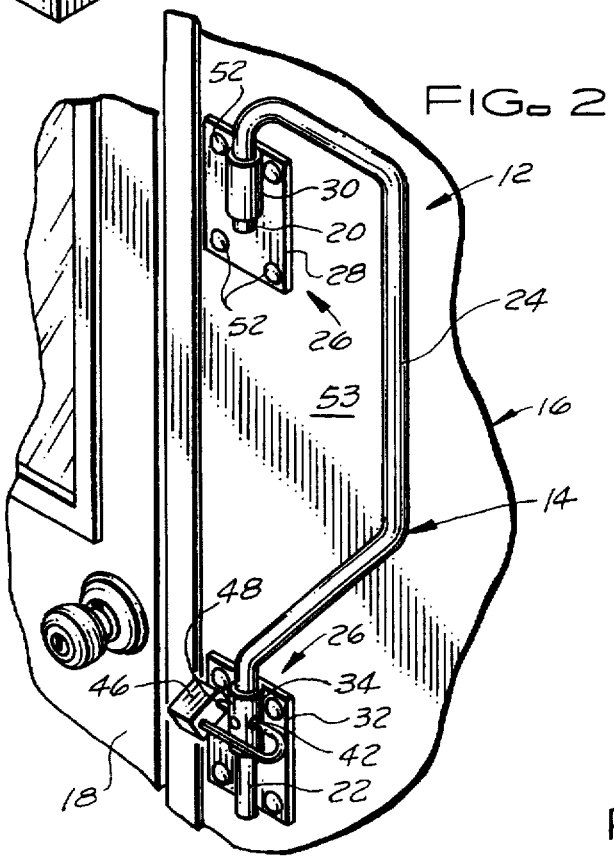
FIG. 2 illustrates pictorially, in perspective, the grab bar system of the preferred embodiment of FIG. 1 according to the present invention in position for use for stowing flat against a recreational vehicle for travel.

With reference to FIG. 2, grab bar 14 may be locked into the position in which grab bar 14 is stowed flat against the recreational vehicle 16 in position for safe travel. In this position for safe travel, a bar portion 48 of padlock 46 will be made to pass through holes 42 and 38, which are constructed to be aligned when grab bar 14 settles into a said stable position and is properly rotated.

Figure 3:
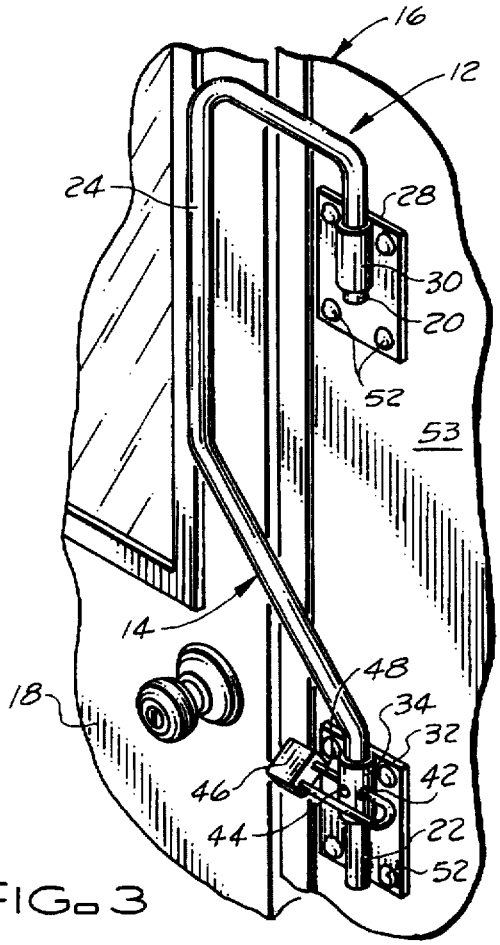
FIG. 3 illustrates pictorially, in perspective, the grab bar system of the preferred embodiment of FIG. 1 according to the present invention in position for use for barring opening of the door of a recreational vehicle.

With reference to FIG. 3, grab bar 14 may be locked into the position in which grab bar 14 is restricting or barring opening of door 18 of recreational vehicle 16, for security, as discussed above. It is seen that the longest horizontal dimension of grab bar 14 must be appropriately longer (depending on strength of materials) than the distance from door 18 to the location of cylinders 30 and 34 within which grab bar 14 is mounted or grab bar 14 will not effectively bar door 18 when properly rotated into position. In this position for barring opening of door 18, a bar portion 48 of padlock 46 will be made to pass through holes 42 and 38, which are constructed to be aligned when grab bar 14 settles into a said stable position and is properly rotated. This locking is similar to that of FIG. 2, except that hole 38 has been rotated about 180 degrees between its positions of FIG. 2 and FIG. 3. Padlock 46, of course is equipped with key 51 to lock the same.

FIG. 6 shows the details of the mounting of brackets 28 and 32 on recreational vehicle 16. As shown, bolts 52 are placed through bracket holes **52*a* and vehicle wall holes 52*b* from the exterior surface 53 of the vehicle 16 to the interior surface 55 of vehicle 16, where matching nuts 54 are attached to secure bolts 52** for this mounting in well-known ways.

With reference to the embodiment of the locking means of FIGS. 7 and 8, it is easily seen that a lock 56 may be inserted into hole 44 to lock, in well-known ways, grab bar 14 into any of the three positions desired without any modification of grab bar 14.

All elements of the grab bar system 12 may be made in well-known ways from steel or other rigid materials with well-known properties within well-known dimensions, depending in most cases on the properties of the materials chosen. Obviously, the dimensions such as the grab bar end thicknesses are limited by the locking-means dimensions chosen.

Thus, in accordance with the present invention, a recreational vehicle user is provided with an efficient way to provide a grab bar which will also serve the important security purpose of barring opening of the vehicle door, even from the inside.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. In a grab bar system of the type wherein a grab bar is mounted outside a recreational vehicle and adjacent an outward-opening door, the improvement comprising, in combination:

a. a grab bar, lying essentially in a vertical plane, for assisting entry to said recreational vehicle when said grab bar is in a first position in a plane essentially perpendicular to the plane of said door when said door is in a closed position, i. said grab bar having a longest horizontal dimension longer than the distance from said door to the location where said grab bar is mounted;

b. mounting means for mounting said grab bar on said recreational vehicle in such manner as to permit pivoting of said grab bar about a vertical axis next to said recreational vehicle; and c. locking means structured and arranged for i. locking said grab bar, for assisting entry to said recreational vehicle, into said first position essentially perpendicular to said plane of said door when said door is in a closed position, and ii. locking said grab bar, for barring opening of said door, into a second position adjacent to an outside portion of said door and essentially parallel to said plane of said door when said door is in a closed position;

d. wherein said grab bar comprises a handle portion having an upper and a lower cylindrical end portion, each said cylindrical end portion being vertical and pointed downward.

2. The grab bar system of claim 1 wherein said mounting means comprises an upper substantially vertical hollow cylinder for receiving said upper cylindrical end portion of said grab bar and a lower substantially vertical hollow cylinder for receiving said lower cylindrical end portion of said grab bar.

3. The grab bar system of claim 2 wherein said locking means comprises:

a. at least one substantially horizontal first hole in at least one of said vertical end portions of said grab bar;

b. at least one substantially horizontal second hole in at least one of said hollow cylinders;

c. said first hole and said second hole being positioned substantially in line; and d. lockable bar means for passing through both said first hole and said second hole.

4. The grab bar system of claim 3 wherein:

a. said first hole lies in said vertical plane of said grab bar;

b. said second hole in the at least one of said hollow cylinders is essentially perpendicular to said plane of said door when said door is in a closed position;

c. said at least one of said hollow cylinders includes a third hole essentially parallel to said plane of said door when said door is in a closed position;

d. said first hole, said second hole, and said third hole being positioned in essentially the same horizontal plane;

e. said lockable bar means is structured and arranged for i. passing through both said first hole and said second hole essentially perpendicular to said plane of said door when said door is in a closed position, to lock said grab bar in position for assisting entry to said recreational vehicle, and ii. passing through both said first hole and said third hole essentially parallel to said plane of said door when said door is in a closed position, to lock said grab bar in position for barring opening of said door.

5. The grab bar system of claim 4 wherein:

a. said lockable bar means is structured and arranged for i. passing through both said first hole and said third hole essentially parallel to said plane of said door when said door is in a closed position, to lock said grab bar in position for stowing flat against said recreational vehicle for safe travel.

* * * * *